US010732558B2

(12) United States Patent
Taniguchi

(10) Patent No.: US 10,732,558 B2
(45) Date of Patent: Aug. 4, 2020

(54) IMAGE FORMING APPARATUS

(71) Applicant: CANON KABUSHIKI KAISHA, Tokyo (JP)

(72) Inventor: Koichi Taniguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/582,661

(22) Filed: Sep. 25, 2019

(65) Prior Publication Data

US 2020/0103812 A1 Apr. 2, 2020

(30) Foreign Application Priority Data

Sep. 27, 2018 (JP) ..... 2018-181688

(51) Int. Cl.
*G03G 15/00* (2006.01)
*G03G 15/01* (2006.01)

(52) U.S. Cl.
CPC ..... *G03G 15/6561* (2013.01); *G03G 15/0131* (2013.01)

(58) Field of Classification Search
CPC ..... G03G 15/6561
See application file for complete search history.

(56) References Cited

U.S. PATENT DOCUMENTS

2007/0110461 A1* 5/2007 Yoshida ..... G03G 21/20 399/44
2015/0117912 A1* 4/2015 Kamiyama ..... G03G 15/0131 399/301

FOREIGN PATENT DOCUMENTS

JP 2010-091925 A 4/2010

* cited by examiner

*Primary Examiner* — Victor Verbitsky
(74) *Attorney, Agent, or Firm* — Venable LLP

(57) ABSTRACT

An image forming apparatus is configured to calculate an estimated value of a color misregistration amount based on a first estimation expression when a temperature of an exposure device is under a temperature increasing state. The image forming apparatus is configured to calculate the estimated value of the color misregistration amount based on the first estimation expression when the temperature of the exposure device is under the temperature decreasing state and the exposure device is not in a thermally-deformed state. The image forming apparatus is configured to calculate the estimated value of the color misregistration amount based on a second estimation expression when the temperature of the exposure device is in the temperature decreasing state and the exposure device is in the thermally-deformed state. The image forming apparatus is configured to correct color misregistration based on the calculated estimated value.

7 Claims, 9 Drawing Sheets

IMAGE FORMING APPARATUS

BACKGROUND OF THE INVENTION

Field of the Invention

The present disclosure relates to an image forming apparatus configured to superimpose a plurality of images of different colors to form a color image.

Description of the Related Art

An electrophotographic color image forming apparatus includes a plurality of image forming portions configured to form images of different colors. Each of the image forming portions includes a photosensitive member configured to form an image of a corresponding color. The image forming apparatus is configured to transfer images of different colors, which are formed on the photosensitive members of the image forming portions, in a superimposed manner to form a full-color image.

Such an image forming apparatus includes a scanning optical device configured to expose the photosensitive member with light in order to form an electrostatic latent image on the photosensitive member. The scanning optical device includes a light source configured to emit light, and optical components (lens and mirror). The light source of the scanning optical device emits light, thereby heat is generated.

The heat may cause deformation or positional changes of the optical components in the scanning optical device. Such changes may cause changes of an irradiation position of the photosensitive member. The change of the irradiation position leads to a positional shift when the images of different colors are superimposed one after another, and causes change in hue of an image formed on a sheet. Such a shift of an image forming position is hereinafter referred to as "color misregistration".

A color misregistration amount is detected as follows. First, a pattern image for color misregistration detection is formed on an intermediate transfer member at a predetermined timing. This pattern image is read by a sensor. The color misregistration amount is detected based on a result of reading the pattern image by the sensor. The image forming apparatus adjusts the laser light irradiation position based on the detected color misregistration to correct the image forming position.

Further, there is also known a method of detecting the color misregistration amount based on a temperature detected by a temperature sensor mounted in the image forming apparatus. A correspondence between the temperature in the image forming apparatus (in-apparatus temperature) and the color misregistration amount is detected in advance, and the color misregistration amount is estimated based on the in-apparatus temperature. In this manner, the color misregistration amount can be detected without using the pattern image.

An image forming apparatus described in Japanese Patent Application Laid-open No. 2010-91925 is configured to switch tables to be used for estimation of the color misregistration amount between a table for the time of temperature increase and a table for the time of temperature decrease. This image forming apparatus can estimate the color misregistration amount with reference to the table with high accuracy even when, after the temperature is increased for a long time period, the image forming apparatus is left as it is and thus the in-apparatus temperature is decreased.

When the in-apparatus temperature clearly changes to increase and decrease at intervals of long time periods, it is effective to employ switching of the tables for estimating the color misregistration amount between the table for the time of temperature increase and the table for the time of temperature decrease. However, when the image forming apparatus performs an operation that causes the temperature to repeatedly increase and decrease within a short time period, a difference between an estimated value of the color misregistration amount at the time of temperature increase and an estimated value of the color misregistration amount at the time of temperature decrease is integrated to cause a large error. Specifically, in a case in which a color misregistration amount per 0.1° C. at the time of temperature increase is represented by X, and a color misregistration amount per 0.1° C. at the time of temperature decrease is represented by Y, when the temperature increase of 0.1° C. and the temperature decrease of 0.1° C. are repeated, an integrated value of the color misregistration amounts becomes $(X-Y)\times n$ (n: repeat count). Therefore, the difference (error) between the color misregistration amount X and the color misregistration amount Y is integrated. When such an error is integrated, an estimated correction value of the color misregistration amount corresponding to the estimated value of the color misregistration amount becomes quite different from a correction value corresponding to an actual color misregistration amount. The present disclosure has been made to solve the above-mentioned problem, and has an object to suppress a detection error of color misregistration even when temperature increase and temperature decrease are repeated in a short time period.

SUMMARY OF THE INVENTION

An image forming apparatus according to the present disclosure includes: a first image forming unit configured to form a first image of a first color, the first image forming unit including: a first photosensitive member; a first exposure unit configured to expose the first photosensitive member with light in order to form a first electrostatic latent image; and a first developing unit configured to develop the first electrostatic latent image formed on the first photosensitive member; a second image forming unit configured to form a second image of a second color that is different from the first color, the second image forming unit including: a second photosensitive member; a second exposure unit configured to expose the second photosensitive member with light in order to form a second electrostatic latent image; and a second developing unit configured to develop the second electrostatic latent image formed on the second photosensitive member; a transfer member onto which the first image and the second image are to be transferred; a transfer nip at which the first image and the second image are transferred onto a sheet from the transfer member; a sensor configured to measure a color pattern formed on the transfer member, the color pattern being used for detection of color misregistration; a temperature sensor, which is provided in the first exposure unit, and is configured to detect a temperature; and a controller configured to: control the first image forming unit and the second image forming unit to form a plurality of color patterns including a color pattern of the first color and a color pattern of the second color; control the sensor to measure the plurality of color patterns; detect first color misregistration between the color pattern of the first color and the color pattern of the second color based on a measurement result of the sensor; determine, in a case where (i) the detected temperature is increased, second color misregistration from the detected temperature based on a first determination condition; determine, in a case where (ii) the detected temperature is decreased and (iii) a time period elapsed from the previous image formation is longer than a predetermined time period, the second color misregistration from the detected temperature based on a second determination condition that is different from the first determination condition; determine, in a case where (iv) the detected temperature is decreased and (v) the elapsed time period is shorter than the predetermined time period, the second color misregistration from the detected temperature based on a third determination condition that is different from the second determination condition; and correct relative positions of an image to be formed by the first image forming unit and an image to be formed by the second image forming unit based on the first color misregistration and the second color misregistration.

Further features of the present invention will become apparent from the following description of exemplary embodiments (with reference to the attached drawings).

DESCRIPTION OF THE EMBODIMENTS

Now, an embodiment of the present disclosure is described in detail with reference to the drawings.

Configuration of Image Forming Apparatus

Figure 1:
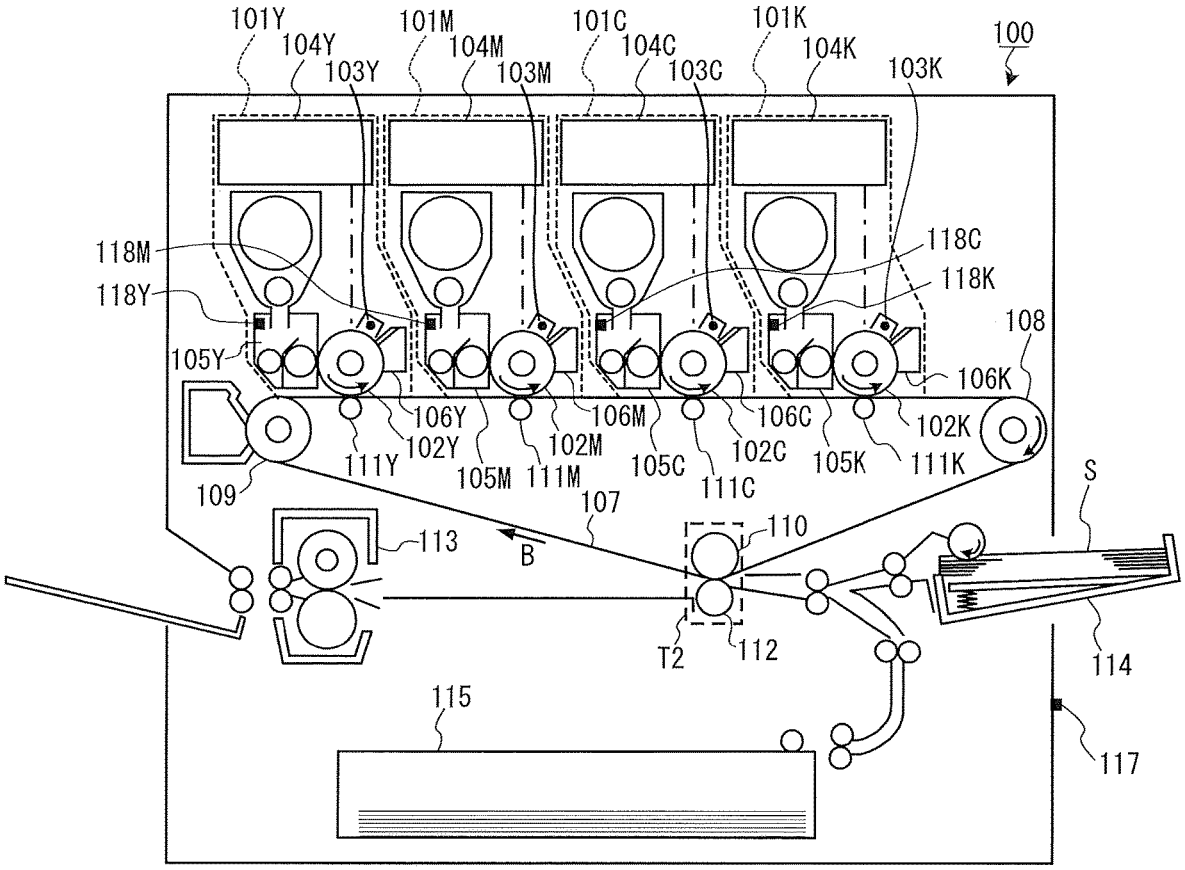
FIG. 1 is an explanatory view for illustrating a configuration of an image forming apparatus.

FIG. 1 is an explanatory view for illustrating a configuration of an image forming apparatus. An image forming apparatus 100 is, for example, a digital full-color printer configured to form a color image with use of toners of a plurality of colors. In this embodiment, the image forming apparatus 100 configured to form a color image is described as an example, but the image forming apparatus is also applicable to a case in which an image is formed with use of toner of a single color (for example, black). In the case of a single color, no color misregistration occurs, and hence image magnification is to be corrected.

The image forming apparatus 100 includes four image forming portions 101Y, 101M, 101C, and 101K configured to form images of different colors. The image forming portion 101Y is configured to form an image with use of yellow toner. The image forming portion 101M is configured to form an image with use of magenta toner. The image forming portion 101C is configured to form an image with use of cyan toner. The image forming portion 101K is configured to form an image with use of black toner. In this case, suffixes Y, M, C, and K at the ends of the reference numerals represent yellow, magenta, cyan, and black, respectively. In the following, suffixes Y, M, C, and K are omitted when a description is made without distinction of the colors.

The image forming portion 101 includes a photosensitive drum 102, a charging device 103, an exposure device 104 serving as a scanning optical device, a developing device 105, and a drum cleaner 106. The photosensitive drum 102 includes a photosensitive member layer (photosensitive layer). The charging device 103, the exposure device 104, the developing device 105, and the drum cleaner 106 are provided around the photosensitive drum 102. The image forming portion 101 forms a toner image on the photosensitive drum 102 through processes of charging, exposure, and development. A yellow toner image is formed on the photosensitive drum 102Y. A magenta toner image is formed on the photosensitive drum 102M. A cyan toner image is formed on the photosensitive drum 102C. A black toner image is formed on the photosensitive drum 102K. The developing device 105 stores developer (toner) of a corresponding color. The developing device 105 includes a developing temperature sensor 118. The developing temperature sensor 118 is configured to detect a developing temperature corresponding to the temperature of the image forming portion 101.

Below the photosensitive drum 102, an intermediate transfer belt 107 serving as a belt-like intermediate transfer member is arranged. The intermediate transfer belt 107 is stretched by a drive roller 108 and driven rollers 109 and 110. The intermediate transfer belt 107 is configured to bear an image (toner image) and convey the image in an arrow B direction. A primary transfer roller 111 is provided at a position opposing the photosensitive drum 102 through intermediation of the intermediate transfer belt 107. The intermediate transfer belt 107, the drive roller 108, the driven rollers 109 and 110, and the primary transfer roller 111 construct an intermediate transfer unit. The primary transfer roller 111 is configured to transfer the toner image formed on the photosensitive drum 102 onto the intermediate transfer belt 107.

The image forming apparatus 100 further includes a secondary transfer roller 112 and a fixing device 113. The secondary transfer roller 112 is configured to transfer the toner images formed on the intermediate transfer belt 107 onto a sheet S. The fixing device 113 is configured to fix the toner images transferred onto the sheet S. The secondary transfer roller 112 and the driven roller 110 construct a secondary transfer portion T2. The image forming apparatus 100 further includes an environment temperature sensor 117 configured to detect a temperature of an environment around a place in which the image forming apparatus 100 is installed (environment temperature).

An operation to be performed at the time of image formation by the image forming apparatus 100 having such a configuration is described.

The charging device 103 of the image forming portion 101 charges the photosensitive layer of the photosensitive drum 102 to be driven to rotate. The exposure device 104 emits laser light to the charged photosensitive layer of the photosensitive drum 102 to expose (scan) the photosensitive layer. With this, an electrostatic latent image is formed on the photosensitive layer of the rotating photosensitive drum 102. The electrostatic latent image is developed by the developing device 105 as a toner image of a corresponding color.

The primary transfer roller 111 is applied with a transfer bias to transfer the toner image from the photosensitive drum 102 onto the intermediate transfer belt 107. In this embodiment, at timings in synchronization with the rotation of the intermediate transfer belt 107, toner images are transferred onto the intermediate transfer belt 107 in a superimposed manner in order of the photosensitive drum 102Y, the photosensitive drum 102M, the photosensitive drum 102C, and the photosensitive drum 102K. In this manner, toner images of four colors are formed on the intermediate transfer belt 107. Toner remaining on the photosensitive drum 102 that has finished the transfer is removed by the drum cleaner 106.

The toner images of four colors transferred onto the intermediate transfer belt 107 are transferred (secondarily transferred) onto the sheet S by the secondary transfer roller 112. At this time, the sheet S is conveyed from a manual feed cassette 114 or a feed cassette 115 to the secondary transfer portion T2 in synchronization with the timing at which the toner images of the four colors are conveyed to the secondary transfer portion T2. The sheet S having the toner images transferred thereon is conveyed to the fixing device 113. The fixing device 113 heats and fixes the toner images to the sheet S. In this manner, a full-color image is formed on the sheet S. The sheet S having the image formed thereon is discharged to a sheet discharging portion.

In the image forming process as described above, it is known that an optimum process condition varies depending on the temperature of the internal environment of the image forming portion 101.

In particular, in a configuration in which toner images of a plurality of colors are transferred onto the intermediate transfer belt 107 in a superimposed manner and thus a full-color toner image is formed, color misregistration occurs due to the shift of positions at which the toner images of the four colors are formed. A color misregistration amount changes depending on an in-apparatus temperature of the image forming apparatus 100. In particular, a temperature (scanner temperature) of the exposure device 104 greatly affects the color misregistration amount. The image forming apparatus 100 according to this embodiment forms an image while appropriately changing the process condition depending on the scanner temperature being the temperature of the exposure device 104.

Figure 2A:
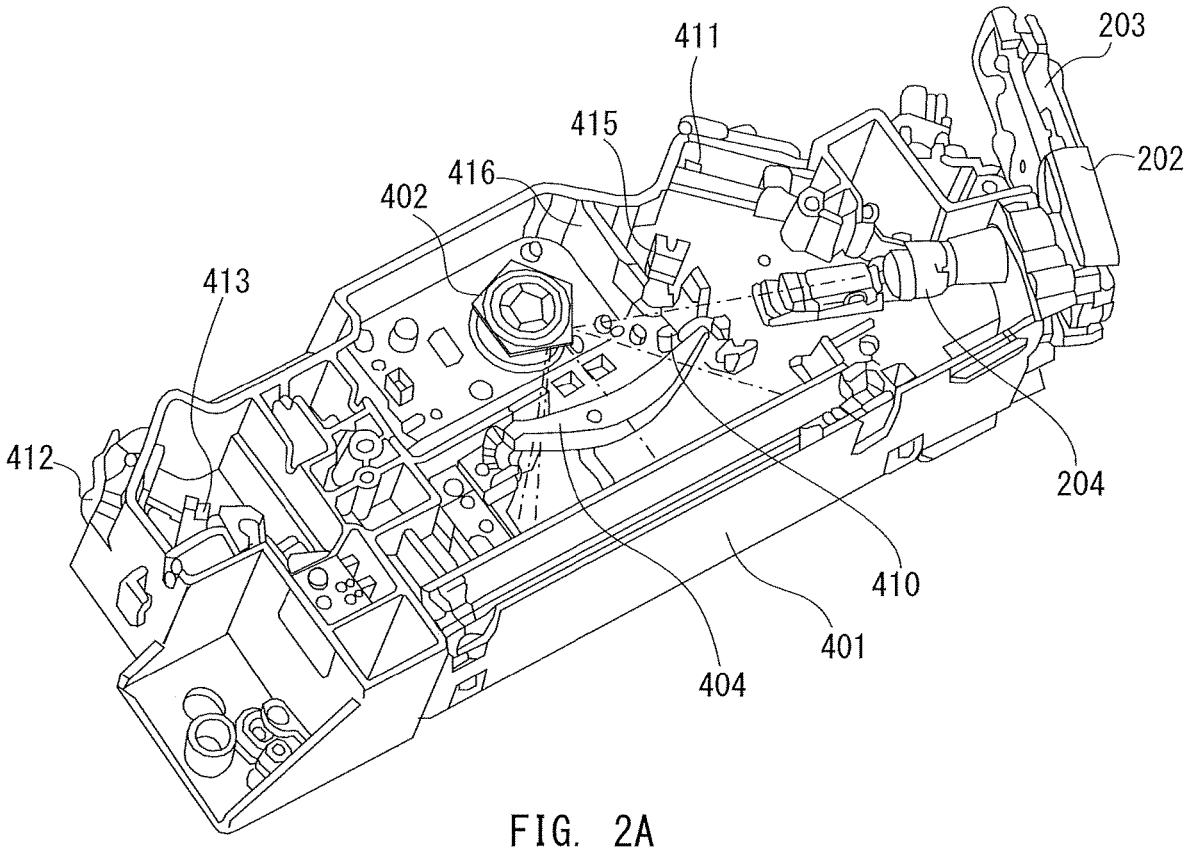
FIG. 2A and FIG. 2B are explanatory views for illustrating a configuration of a scanning optical device.
Figure 2B:
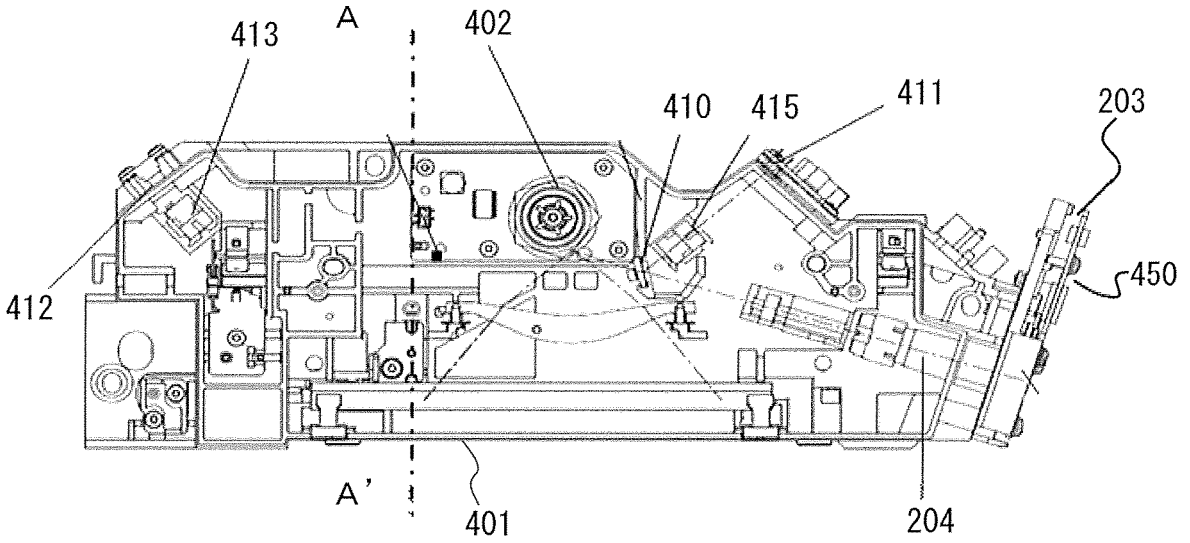
Figure 3A:
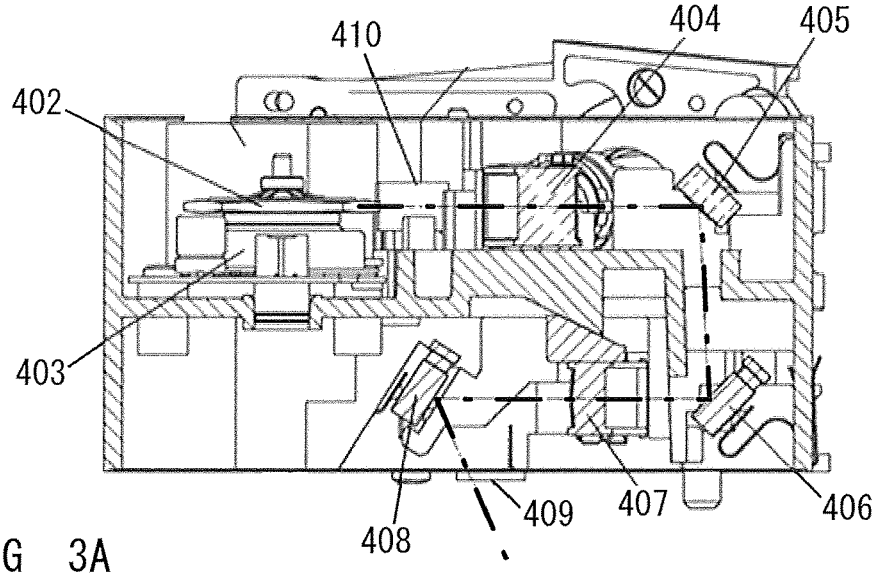
FIG. 3A and FIG. 3B are explanatory views for illustrating the configuration of the scanning optical device.
Figure 3B:
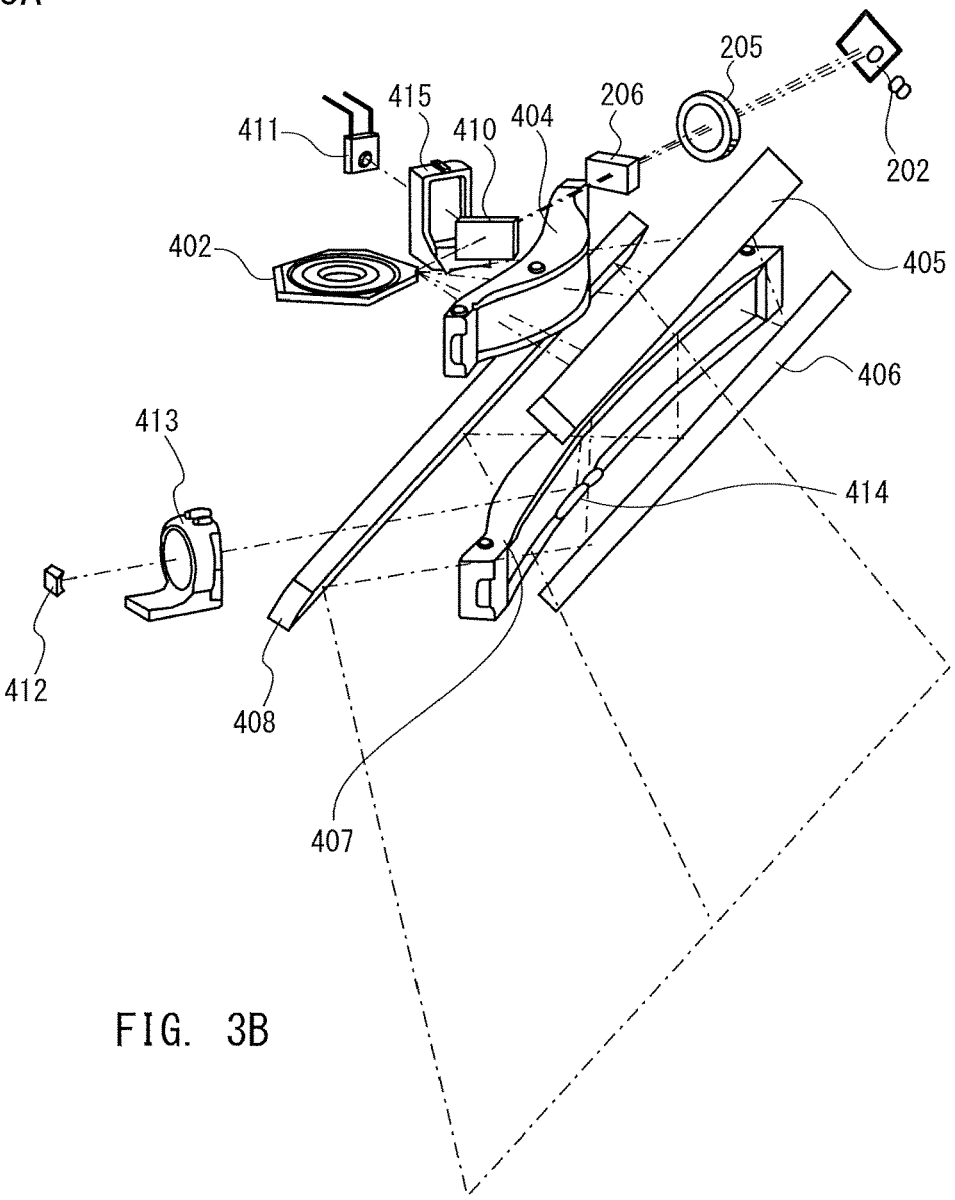

FIG. 2A, FIG. 2B, FIG. 3A, and FIG. 3B are explanatory views for illustrating the configuration of the exposure device 104. FIG. 2A is a perspective view for illustrating the exposure device 104. FIG. 2B is a top view for illustrating the exposure device 104. FIG. 3A is an A-A' sectional view of FIG. 2B. FIG. 3B is a partially-exploded perspective view for illustrating the exposure device 104.

The exposure device 104 includes, in an optical box 401 serving as a case, a configuration for scanning the photosensitive drum 102 with laser light. The optical box 401 has an optical unit mounted thereon. The optical unit includes, for example, a laser light source and a control board (board 203) configured to drive the laser light source. The laser light source in this embodiment is a vertical cavity surface emitting laser (hereinafter referred to as "VCSEL") 202. The VCSEL 202 includes a plurality of light emitting elements. The optical box 401 stores an optical system for forming an image on the photosensitive drum 102 corresponding to the laser light emitted from the VCSEL 202 (optical unit). The optical system includes a lens barrel portion 204, and a rotary polygon mirror 402 configured to deflect the laser light so as to scan the photosensitive drum 102 in a predetermined direction.

The rotary polygon mirror 402 is driven to rotate by a motor 403 illustrated in FIG. 3A. The laser light deflected by the rotary polygon mirror 402 enters a first fθ lens 404. The laser light that has passed through the first fθ lens 404 is reflected by a reflection mirror 405 and a reflection mirror 406 to enter a second fθ lens 407. The laser light that has passed through the second fθ lens 407 is reflected by a reflection mirror 408, and passes through a dust-proof glass 409 to be guided onto the photosensitive drum 102. With the above-mentioned configuration, the laser light scanned by the rotary polygon mirror 402 at a constant angular velocity is imaged on the photosensitive drum 102 by the first fθ lens 404 and the second fθ lens 407, and is scanned on the photosensitive drum 102 at a constant velocity.

In the exposure device 104 in this embodiment, as illustrated in FIG. 3B, the laser light emitted from the VCSEL 202 passes through a collimator lens 205 and a cylindrical lens 206 to travel toward the rotary polygon mirror 402. The collimator lens 205 and the cylindrical lens 206 are provided in the lens barrel portion 204.

The exposure device 104 in this embodiment further includes a beam splitter 410. The beam splitter 410 is arranged on an optical path of the laser light that exits from the lens barrel portion 204 to travel toward the rotary polygon mirror 402. The laser light that has reached the beam splitter 410 is split into a first laser light corresponding to transmitted light and a second laser light corresponding to reflected light. The first laser light is deflected by the rotary polygon mirror 402 to be guided to the photosensitive drum 102 as described above. The second laser light passes through a condenser lens 415, and then enters a photodiode (hereinafter abbreviated to "PD 411") serving as a photoelectric conversion element (light receiver). The PD 411 outputs a detection signal corresponding to a received light amount. Automatic power control (APC) is performed based on the detection signal output from the PD 411.

The exposure device 104 in this embodiment further includes a beam detector (hereinafter abbreviated to "BD 412"). The BD 412 generates a synchronization signal for determining an emission timing (writing start position) of the laser light on the photosensitive drum 102 based on image data. The laser light (first laser light) deflected by the rotary polygon mirror 402 passes through the first fθ lens 404, and is reflected by the reflection mirror 405 and a reflection mirror 414 (see FIG. 3B) to enter the BD 412. The laser light passes through an optical system 413 including a plurality of lenses before entering the BD 412.

As illustrated in FIG. 2B, on the board 203, a scanner temperature sensor 450 is mounted. The scanner temperature sensor 450 detects a temperature (scanner temperature) inside the optical box 401 (inside the exposure device 104). Results of detecting the temperature by the scanner temperature sensor 450 are fed back so that color misregistration is corrected.

Figure 4:
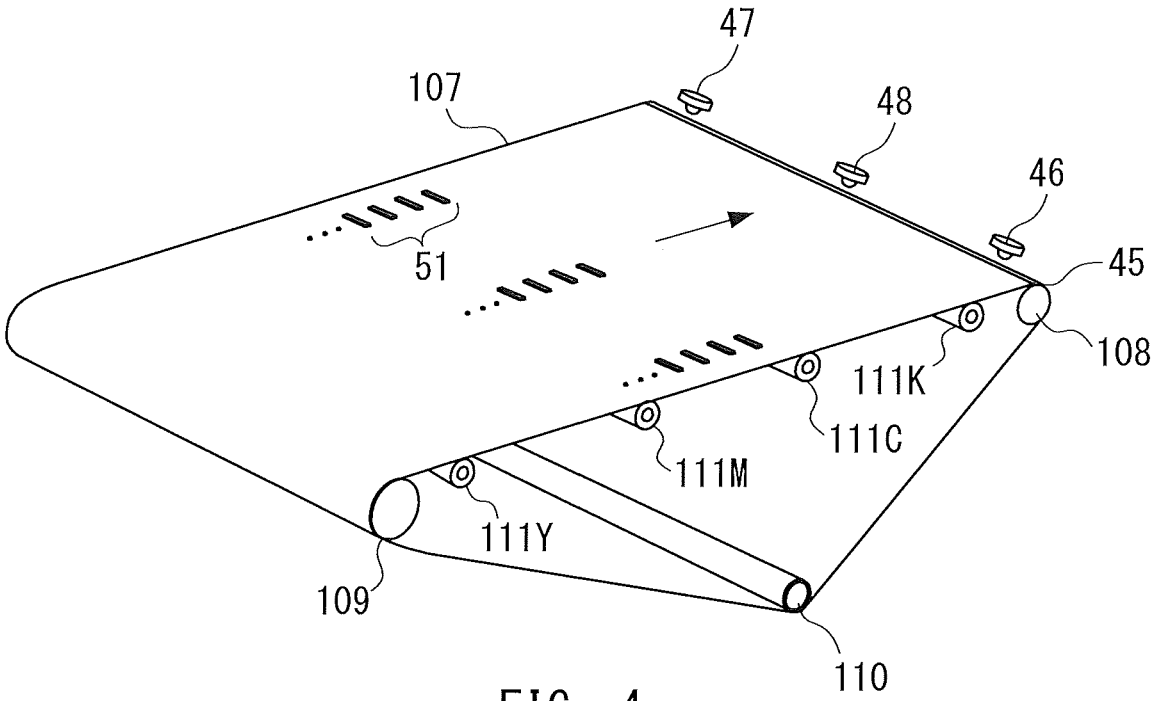
FIG. 4 is an explanatory view for illustrating color misregistration sensors and pattern images.
Figure 5:
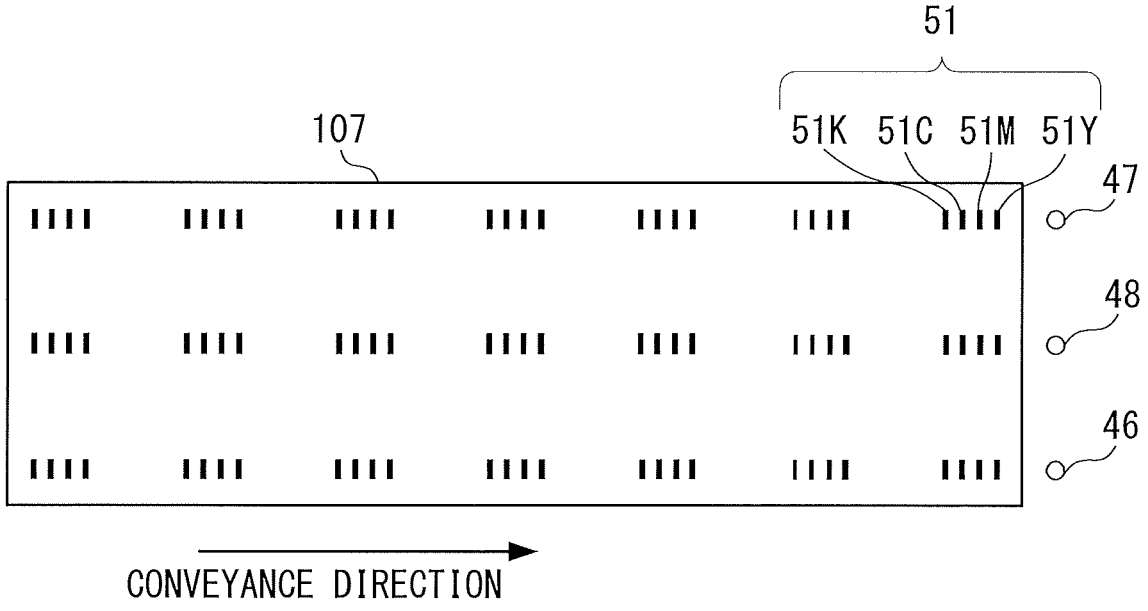
FIG. 5 is an explanatory view for illustrating the color misregistration sensors and the pattern images.

FIG. 4 and FIG. 5 are explanatory views for illustrating color misregistration sensors provided close to the intermediate transfer belt 107, and pattern images for color misregistration detection (hereinafter referred to as "detection images"). Color misregistration sensors 46, 47, and 48 are optical sensors, and are configured to detect detection images 51 formed on the intermediate transfer belt 107. The color misregistration sensors 46, 47, and 48 are arranged downstream of the image forming portion 101K in a conveyance direction in which the intermediate transfer belt 107 conveys the detection images 51. Detection positions of the color misregistration sensors 46, 47, and 48 differ in a direction (main scanning direction) orthogonal to the conveyance direction in which the intermediate transfer belt 107 conveys the detection images 51. The color misregistration sensor 46 is arranged on the front side of the image forming apparatus 100 (front side in FIG. 1). The color misregistration sensor 47 is arranged on the rear side of the image forming apparatus 100 (depth side in FIG. 1). The color misregistration sensor 48 is arranged in the middle between the color misregistration sensor 46 and the color misregistration sensor 47. The main scanning direction refers to a direction in which the exposure device 104 scans the photosensitive drum 102 with the laser light. A sub-scanning direction refers to a direction orthogonal to the main scanning direction.

As illustrated in FIG. 5, the detection image 51 is formed by combining detection patches 51Y, 51M, 51C, and 51K of the four colors. The detection patch 51Y is a yellow image. The detection patch 51M is a magenta image. The detection patch 51C is a cyan image. The detection patch 51K is a black image. The detection patches 51Y, 51M, 51C, and 51K are images for detecting the color misregistration amounts in the sub-scanning direction of the images of the four colors. The detection patches 51Y, 51M, 51C, and 51K are formed into a rectangular shape having a long side that is parallel to the main scanning direction, and are arranged side by side in the conveyance direction of the intermediate transfer belt 107 (sub-scanning direction).

Figure 6:
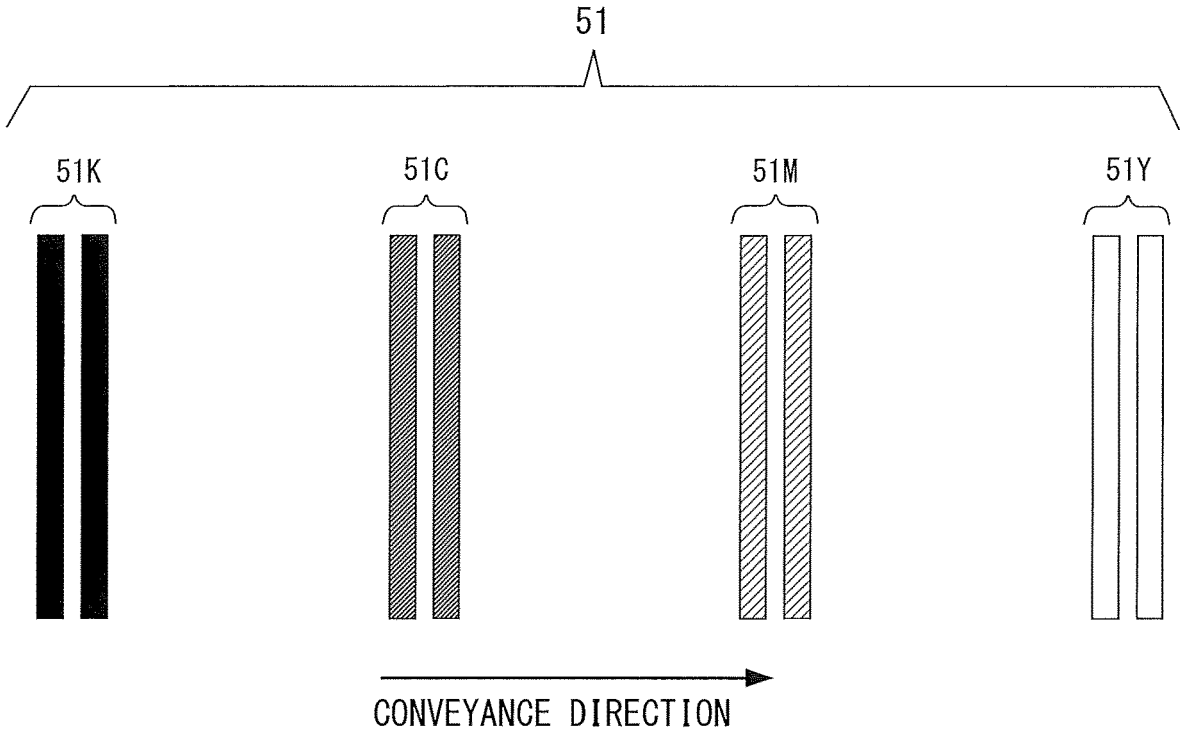
FIG. 6 is an enlarged view for illustrating the pattern image.

FIG. 6 is an enlarged view for illustrating the detection patches 51Y, 51M, 51C, and 51K. Each of the detection patches 51Y, 51M, 51C, and 51K of the four colors includes two rectangular images formed at a certain interval in the conveyance direction (sub-scanning direction). Each of the detection patches 51Y, 51M, 51C, and 51K of the four colors is formed by the two images, and hence, through a comparison of the results of detecting the two images, it is possible to prevent, for example, dust and foreign matters from being erroneously recognized as the detection patches 51Y, 51M, 51C, and 51K.

The shape of the detection patch 51 is not limited to the shape exemplified in FIG. 5 and FIG. 6, and may be a rectangular shape having a long side that is parallel to the sub-scanning direction, a cross shape, or a triangular shape. The detection patches 51Y, 51M, 51C, and 51K are detected by each of the color misregistration sensors 46, 47, and 48. The color misregistration amount is calculated based on the detection result of each of the color misregistration sensors 46, 47, and 48. The color misregistration amount is not limited to the color misregistration amount in the sub-scanning direction, and also includes the color misregistration amount in the main scanning direction.

In the color misregistration correction using the detection image 51, the actual color misregistration amount on the intermediate transfer belt 107 is detected, and hence color misregistration correction is possible with an accuracy higher than that in a case in which the color misregistration amount is estimated based on the state of the image forming apparatus 100, for example, the in-apparatus temperature of the image forming apparatus 100. However, the detection image 51 is formed on the intermediate transfer belt 107, and hence downtime is caused. Therefore, the color misregistration correction using the detection image 51 is often performed when the estimation accuracy of the color misregistration amount cannot be ensured, that is, when the in-apparatus state change is larger than a predetermined value, such as when the temperature change of the in-apparatus temperature is large. Also in this embodiment, the color misregistration correction using the detection image 51 is performed when the temperature changes (increases or decreases) by a certain amount or more from a temperature at the time of the previous color misregistration correction.

Figure 7:
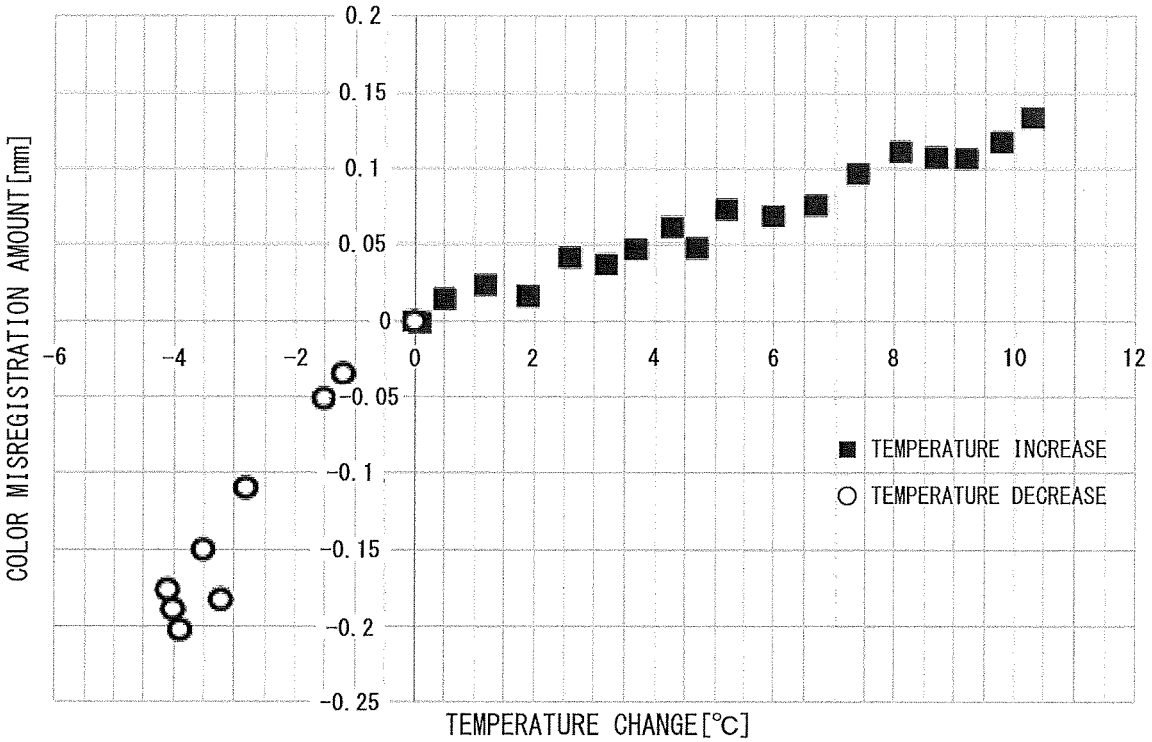
FIG. 7 is a graph for showing a relationship between a temperature change amount and a color misregistration amount.

FIG. 7 is a graph for showing the relationship between the color misregistration amount and a change amount (temperature change amount) of the detection result of the scanner temperature sensor 450. As shown in FIG. 7, it is found that the relationship between the temperature change amount and the color misregistration amount at the time of temperature increase is different from that at the time of temperature decrease, and there is a hysteresis relationship between them. Therefore, it is required to switch methods of estimating the color misregistration amount between the method used when a temperature in the vicinity of the exposure device 104 is increased and the method used when the temperature is decreased. For example, there is known the following method. Estimation expressions or tables representing the relationship between the temperature change amount and the color misregistration amount, which varies between the time of temperature increase and the time of temperature decrease, may be prepared in advance, and the estimation expressions or the tables may be switched and used to estimate the color misregistration amount. In this method, the estimation expressions or the tables are switched even when the image forming apparatus performs such an operation that causes the temperature to repeatedly increase and decrease within a short span, for example, in a case in which the image forming apparatus repeatedly performs printing on a small number of sheets S at intervals, and thus the temperature change is small and there is no influence of the hysteresis. Therefore, the difference in the color misregistration amount between the time of temperature increase and the time of temperature decrease is integrated as an error, and it is difficult to ensure the estimation accuracy. In view of this, in this embodiment, an estimation expression is established with use of the temperature in the vicinity of the exposure device 104.

Figure 8:
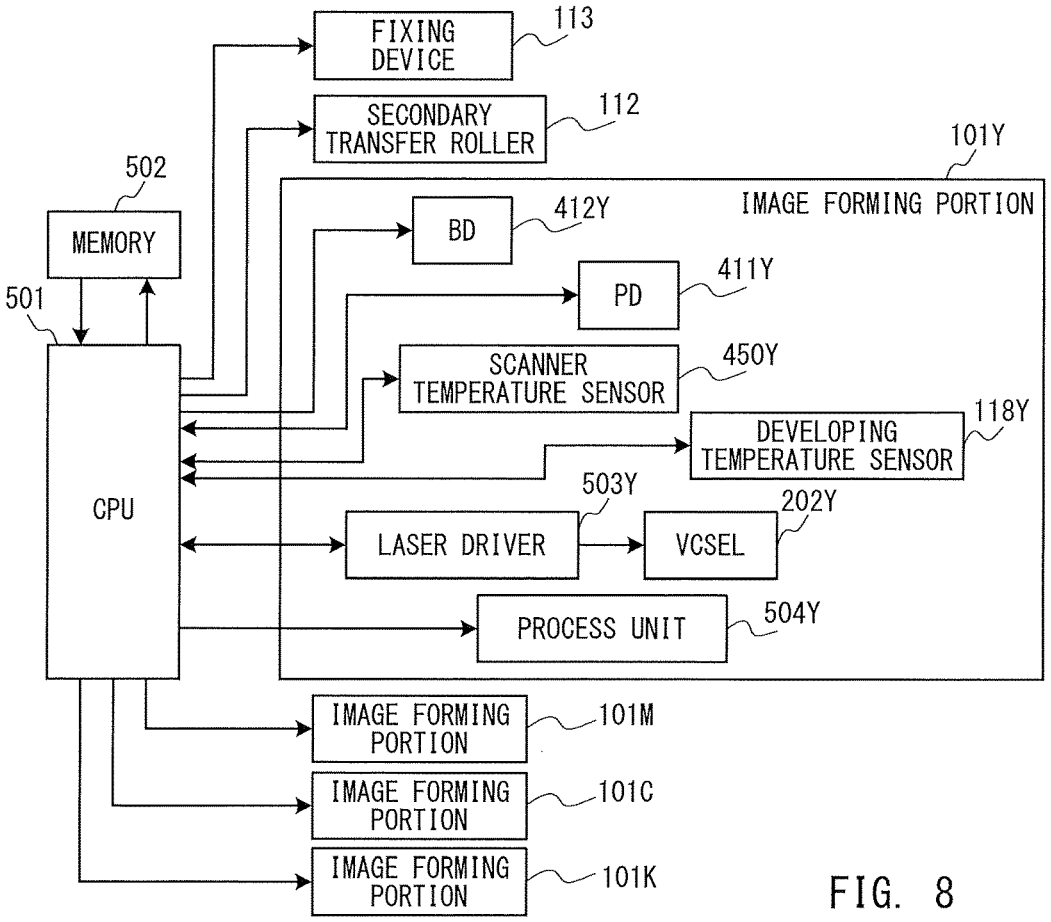
FIG. 8 is an explanatory diagram for illustrating a controller.

FIG. 8 is an explanatory diagram for illustrating a controller configured to control the operation of the image forming apparatus 100. The controller includes a central processing unit (CPU) 501 and a memory 502. The CPU 501 is configured to execute a control program stored in the memory 502 to control the operation of the image forming apparatus 100. The image forming portion 101Y includes, in addition to the above-mentioned BD 412Y, PD 411Y, scanner temperature sensor 450Y, developing temperature sensor 118Y, and VCSEL 202Y, a laser driver 503Y and a process unit 504Y. The image forming portions 101M, 101C, and 101K also have configurations similar to that of the image forming portion 101Y.

A driver configured to drive the photosensitive drum 102Y, the charging device 103Y, the developing device 105Y storing the yellow developer, the drum cleaner 106Y, and the primary transfer roller 111Y are collectively referred to as the "process unit 504Y". A detailed description of control of the process unit 504Y is omitted herein. Further, the CPU 501 controls the secondary transfer roller 112 and the fixing device 113, but a detailed description of the control is omitted herein.

The memory 502 stores, in addition to the control program, timing data defining the emission timing of each VCSEL 202, color misregistration correction data, and other data. The CPU 501 incorporates a clock signal generator such as a crystal oscillator, and a counter. The clock signal generator is configured to generate a clock signal having a frequency higher than that of the synchronization signal, and the counter is configured to count the clock signal.

The CPU 501 acquires the synchronization signal output from the BD 412, the detection signal output from the PD 411, the detection signal output from the developing temperature sensor 118, and the detection signal output from the scanner temperature sensor 450. The CPU 501 transmits a control signal to the laser driver 503 based on the synchronization signal output from the BD 412 and the detection signal output from the PD 411. The control signal is a signal for controlling the timing for the VCSEL 202 to emit laser light and the light amount of the laser light. The laser driver 503 outputs a drive signal for driving the VCSEL 202 based on the control signal. The VCSEL 202 emits laser light by an amount corresponding to the drive signal at a timing corresponding to the drive signal. At this time, the CPU 501 estimates the color misregistration amount based on the detection signal (detected temperature) acquired from the scanner temperature sensor 450, and corrects the drive signal in accordance with the estimated color misregistration amount, to thereby correct the color misregistration. With this color misregistration correction, the color misregistration amount of the actually-formed image of each color is reduced.

First Embodiment

The image forming apparatus 100 according to a first embodiment of the present disclosure acquires the estimated value of the color misregistration amount with use of an estimation expression that varies between the time at which the in-apparatus temperature is increased and the time at which the in-apparatus temperature is decreased. In both of an estimation expression (first estimation expression or first determination condition) at the time of temperature increase and an estimation expression (second estimation expression or second determination condition) at the time of temperature decrease, an estimated value X(n) of this time is calculated with use of an estimated value X(n−1) calculated last time. When the first and second estimation expressions are used, in order to avoid the influence of the hysteresis of the temperature, the detection result (scanner temperature) of the scanner temperature sensor 450 is used for the estimation. Expression (1) and Expression (2) correspond to the first estimation expression and the second estimation expression, respectively.

First Estimation Expression (at the Time of Temperature Increase)

$$X(n)=X(n-1)+\alpha(T(n)-T(n-1)) \quad (1)$$

Second Estimation Expression (at the Time of Temperature Decrease)

$$X(n)=X(n-1)+\beta(T(n)-T(n-1)) \quad (2)$$

T(n) represents a scanner temperature (detected temperature) at the time of the image formation at this time, and T(n−1) represents a scanner temperature (previously detected temperature) at the time of the previous image formation. A temperature increasing state and a temperature decreasing state are determined based on Expressions (3) and (4) below. The temperature is increased when Expression (3) is satisfied, and the temperature is decreased when Expression (4) is satisfied.

$$T(n)-T(n-1)>0 \quad (3)$$

$$T(n)-T(n-1)\leq 0 \quad (4)$$

When Expression (4) is satisfied, it is determined based on the following condition (Expression (5)) whether or not the second estimation expression is finally used. In Expression (5), Time(n) represents time at the time of the image formation at this time, and T(n−1) represents time at the time of the previous image formation. That is, Expression (5) is used to determine whether or not 90 seconds or more has elapsed from the previous image formation.

$$\mathrm{Time}(n)-\mathrm{Time}(n-1)\geq 90 \quad (5)$$

The CPU 501 determines whether the temperature is increased or decreased based on Expression (3) and Expression (4). When the temperature is increased, the CPU 501 calculates the estimated value of the color misregistration amount based on the first estimation expression (Expression (1)). When the temperature is decreased, and Expression (5) is satisfied, the CPU 501 calculates the estimated value of the color misregistration amount based on the second estimation expression (Expression (2)). However, even when the temperature is decreased, when Expression (5) is not satisfied, the CPU 501 calculates the estimated value of the color misregistration amount based on the first estimation expression (Expression (1)). That is, even when the temperature is decreased, whether or not the second estimation expression is finally used is determined based on a time period elapsed from the previous image formation.

The meaning of Expression (5) is described.

The hysteresis is caused between the time at which the scanner temperature (in-apparatus temperature) is increased and the time at which the scanner temperature (in-apparatus temperature) is decreased because a temperature characteristic of the scanner temperature sensor 450 configured to detect the scanner temperature does not match thermal deformation of an object that is causing a shift of the irradiation position of the laser light radiated by the exposure device 104. The object that is causing the shift of the irradiation position of the laser light is, for example, the lens or the optical box 401 of the exposure device 104. Ideally, it is desired that the scanner temperature sensor 450 be arranged at a position capable of obtaining temperature change that is linear to the thermal deformation. However, the object is not thermally deformed locally. Further, the scanner temperature sensor 450 is affected by an air stream caused by the rotation of the motor 403 depending on the position at which the scanner temperature sensor 450 is arranged. Therefore, the scanner temperature sensor 450 is mounted on the board 203. That is, the hysteresis of the scanner temperature is a phenomenon that is unavoidable to some extent.

Expression (4) to be used for determination of temperature decrease is satisfied under such a condition that the object that is causing the shift of the irradiation position of the laser light radiated by the exposure device 104 is thermally deformed to be changed in a contracting direction. That is, when the scanner temperature is decreased, the object is required to be thermally deformed in the contracting direction. However, the decrease of the scanner temperature and the thermal deformation of the object in the contracting direction do not always match in timing. One reason for the mismatch is, for example, the difference between a heat radiation condition regarding the scanner temperature sensor 450 and a heat radiation condition of the object that is actually thermally deformed.

Specifically, the scanner temperature sensor 450 is arranged on the board 203 configured to control the laser light and arranged outside of the exposure device 104. This board 203 has a heat capacity that is overwhelmingly smaller than a heat capacity of the main body of the exposure device 104. Further, the board 203 immediately radiates heat because the board 203 is arranged outside of the optical box 401. Therefore, after light emission is ended, the board 203 is immediately brought into the temperature decreasing state, and the scanner temperature detected by the scanner temperature sensor 450 is also decreased.

Figure 9:
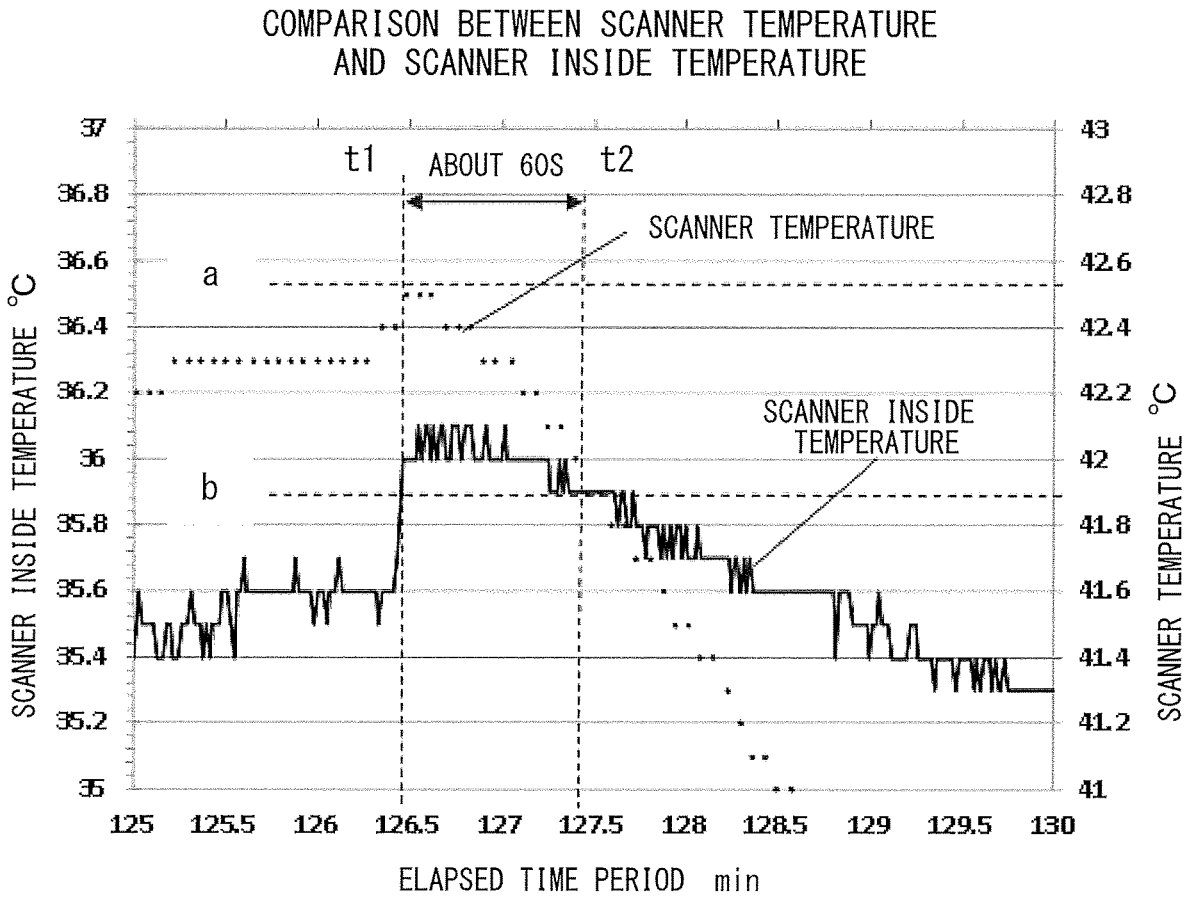
FIG. 9 is a graph for showing a relationship between a scanner temperature and a scanner inside temperature.

On the other hand, the object that is actually thermally deformed corresponds to the optical box 401 of the exposure device 104 or the lens inside of the exposure device 104. FIG. 9 is a graph for showing a relationship between the scanner temperature to be detected by the scanner temperature sensor 450 and a temperature inside of the optical box 401 (scanner inside temperature). The scanner temperature is indicated by the dotted line, and the scanner inside temperature is indicated by the solid line. The scanner inside temperature is detected by a temperature sensor additionally provided in the optical box 401 experimentally. Time t1 corresponds to a timing at which image formation is ended. The scanner temperature to be detected by the scanner temperature sensor 450 starts to decrease immediately after the image formation is ended. In contrast, the scanner inside temperature does not start to decrease until time t2. About 60 seconds elapses from the time t1 to the time t2.

The main heat generating source of the exposure device 104 is sliding heat of a sliding component, which is generated along with the rotation of the motor 403, and heat generated by a semiconductor device on the board 203. The object subjected to thermal deformation is not immediately brought into the temperature decreasing state because of radiant heat and transferred heat even when the image forming processing ends at the time t1 and thus the motor 403 is stopped. Therefore, only after the influence of heat due to heat conduction transfers to the object (time t2), the scanner inside temperature is brought into the temperature decreasing state.

In view of the above, even when the scanner temperature detected by the scanner temperature sensor 450 is decreased, immediate estimation of the color misregistration amount with use of the second estimation expression (Expression (2)) for the time of temperature decrease is required to be avoided. As described with reference to FIG. 9, the exposure device 104 requires a predetermined time period (60 seconds in the first embodiment) or more to shift to the temperature decreasing state after the thermal deformation becomes stable. That is, it is found that at least a predetermined time period (60 seconds) is required for the scanner inside temperature to be brought into the temperature decreasing state, and it takes the predetermined time period or more to reliably obtain the thermally-deformed state. In the first embodiment, a time period corresponding to a threshold value for determining the thermally-deformed state of the object is set to 90 seconds. This time period is desired to be set as appropriate depending on the mounting position of the scanner temperature sensor 450 and the configuration of the exposure device 104.

Figure 10:
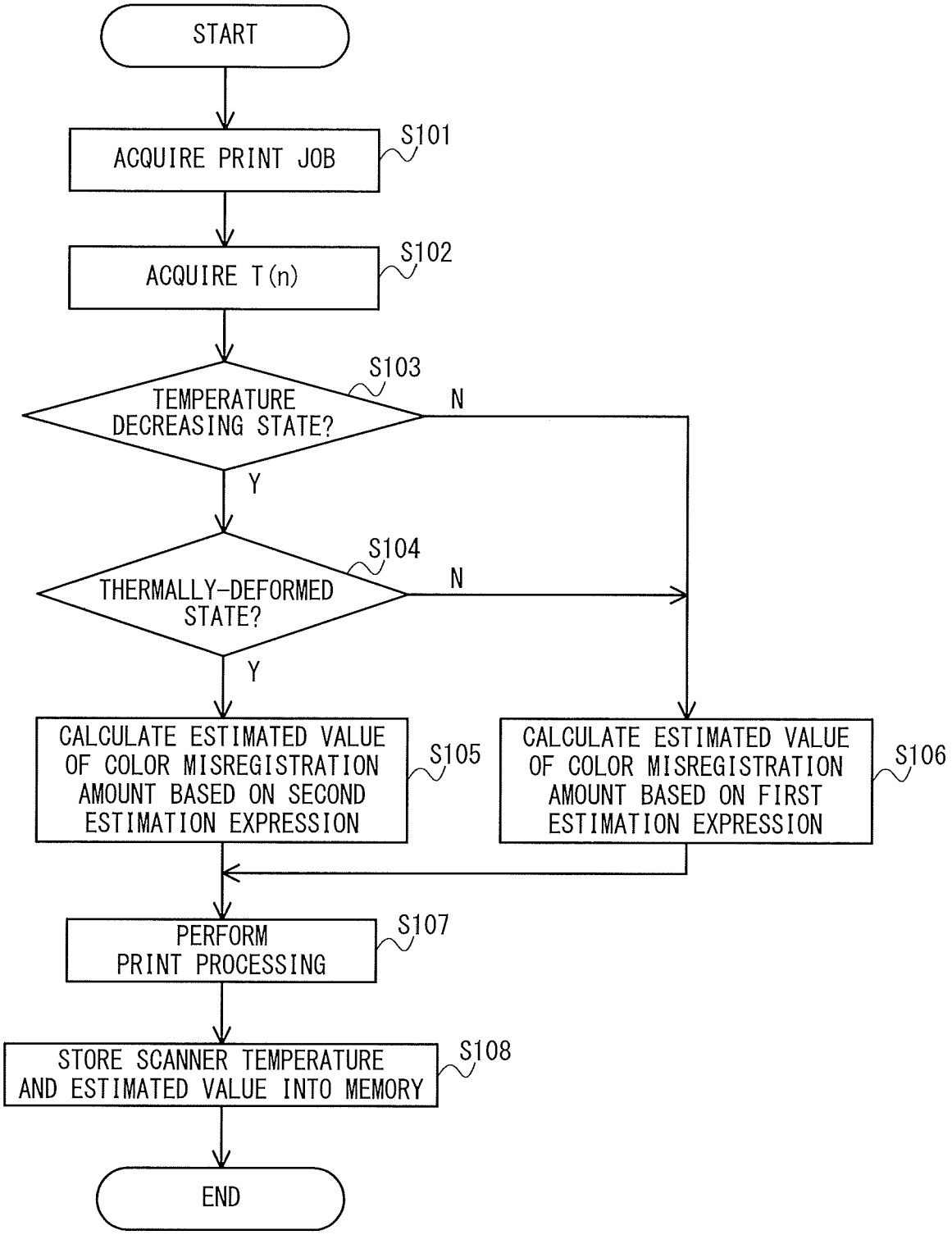
FIG. 10 is a flow chart for illustrating processing of calculating an estimated value of the color misregistration amount.

FIG. 10 is a flow chart for illustrating processing of calculating the estimated value of the color misregistration amount by the image forming apparatus 100 as described above.

The CPU 501 acquires a print job to prepare for image formation (Step S101). Before image formation, the CPU 501 acquires the current scanner temperature T(n) of the exposure device 104 (Step S102). The CPU 501 acquires the scanner temperature T(n) based on the detection result of the scanner temperature sensor 450. The CPU 501 stores the acquired scanner temperature T(n) into the memory 502. The memory 502 stores the scanner temperatures detected in the past and the estimated values of the color misregistration amount calculated in the past.

The CPU 501 acquires the scanner temperature T(n−1) at the time of the previous image formation from the memory 502, and compares the scanner temperature T(n−1) with the current scanner temperature T(n), to thereby determine whether or not the scanner temperature is in the temperature decreasing state (Step S103). The CPU 501 performs this determination based on Expression (4).

When the scanner temperature is in the temperature decreasing state (Step S103: Y), the CPU 501 determines the thermally-deformed state of the exposure device 104 (Step S104). The CPU 501 determines the thermally-deformed state with reference to Expression (5) based on whether or not, at the time of the image formation at this time, a time period (90 seconds) corresponding to the threshold value or more has elapsed from the time of the previous image formation. When the thermally-deformed state satisfying Expression (5) is obtained (Step S104: Y), the CPU 501 calculates the estimated value of the color misregistration amount based on Expression (2) being the second estimation expression (Step S105).

When the scanner temperature is in the temperature increasing state (Step S103: N), or the exposure device 104 is not in the thermally-deformed state (Step S104: N), the CPU 501 calculates the estimated value of the color misregistration amount based on Expression (1) being the first estimation expression (Step S106).

The CPU 501 that has calculated the estimated value of the color misregistration amount based on any one of the first estimation expression and the second estimation expression corrects the color misregistration in accordance with the calculated estimated value, and performs print processing (image forming processing) by the image forming portion 101 in accordance with the print job (Step S107). After the print processing is ended, the CPU 501 stores the scanner temperature T(n) acquired in the processing of Step S102 and the estimated value X(n) of the color misregistration amount calculated in the processing of Step S105 or Step S106 into the memory 502 (Step S108). Specifically, the current scanner temperature T(n) is stored as the scanner temperature T(n−1), and the calculated estimated value X(n) of the color misregistration amount is stored as the estimated value X(n−1).

The above-mentioned processing is repeated at the time of image formation. Thus, even when the scanner temperature changes to increase and decrease in a short time period, the color misregistration amount can be estimated with a smaller error. Therefore, the color misregistration can be corrected with high accuracy based on the estimated value of the color misregistration amount.

Second Embodiment

In the first embodiment, as the condition for determining the thermally-deformed state of the exposure device 104, the time interval of the image forming processing as shown in Expression (5) is used, but the thermally-deformed state of the exposure device 104 can be determined with use of a decrease value of the scanner temperature. Expression (6) is a conditional expression of this case.

$$T(n)-T(n-1)\leq -1 \tag{6}$$

That is, the thermally-deformed state is determined based on the difference between the scanner temperature T(n−1) at the time of the previous image formation and the scanner temperature T(n) at this time. With use of such a conditional expression, an effect similar to that in the determination based on time using the conditional expression of Expression (5) can be expected when the hysteresis is small or the temperature is estimated in a limited region because of the arrangement of the scanner temperature sensor 450.

A description is made with reference to FIG. 9. The scanner temperature detected by the scanner temperature sensor 450 is decreased from a temperature a to a temperature b during a period from the time t1 to the time t2. The difference between the temperature a and the temperature b is about 0.8° C. Even when the scanner temperature is decreased by about 0.8° C., the scanner inside temperature is not decreased. Therefore, the temperature (1° C. in the second embodiment) corresponding to the threshold value for determining that the scanner temperature is in the temperature decreasing state is set in consideration of the variation in temperature.

The CPU 501 determines based on Expression (6) that the exposure device 104 is in the thermally-deformed state when the scanner temperature is decreased by 1° C. or more (decreased by the temperature corresponding to the threshold value or more). That is, when the decrease of the scanner temperature is 1° C. or more, the CPU 501 uses the second estimation expression to calculate the estimated value of the color misregistration amount. On the other hand, when the decrease of the scanner temperature is less than 1° C., the CPU 501 uses another estimation expression that is different from the second estimation expression to calculate the estimated value of the color misregistration amount.

In this case, the other estimation expression may be the first estimation expression, or a third estimation expression (third determination condition) that differs from both of the first estimation expression and the second estimation expression may be used. Expression (7) corresponds to the third estimation expression.

Third Estimation Expression $$X(n)=X(n-1)+\gamma(T(n)-T(n-1)) \quad (7)$$

In the processing of FIG. 10, the CPU 501 determines the thermally-deformed state of the exposure device 104 based on Expression (6) in the processing of Step S104 to select the estimation expression to be used for calculating the estimated value of the color misregistration amount from a plurality of estimation expressions. Other processing is similar to that in the first embodiment. Also, in the second embodiment, even when the scanner temperature changes to increase and decrease in a short time period, the color misregistration amount can be estimated with a smaller error. Therefore, the color misregistration can be corrected with high accuracy based on the estimated value of the color misregistration amount.

Third Embodiment

The color misregistration amount at the time of temperature decrease may be estimated with use of the time period elapsed from the previous image formation.

Expression (8) is an estimation expression (second estimation expression) for the color misregistration amount at the time of temperature decrease, which uses the time period elapsed from the previous image formation. In Expression (8), Time(n) represents time at the time of the image formation at this time, and T(n−1) represents time at the time of the previous image formation.

$$X(n)=X(n-1)+\delta(\mathrm{Time}(n)-\mathrm{Time}(n-1)) \quad (8)$$

Expression (8) is described. As described with reference to Expression (5), the phenomenon occurring at the time of temperature decrease is a heat radiation state caused by heat conduction. In a configuration of a third embodiment of the present disclosure, the scanner temperature increased by the rotation of the motor 403 is decreased through heat radiation. Therefore, when a predetermined time period t elapses after the image formation is ended, the scanner inside temperature of the optical box 401 of the exposure device 104 is expressed by Expression (9) below.

$$T_{Si}=(T_{Hrs}-T_S)\times e^{\wedge}(-H_{con}\times S_a\times t/H_{cap})+T_s \quad (9)$$

$T_{Si}$: Scanner inside temperature
$T_{Hrs}$: Heat radiation start temperature
$T_S$: Scanner temperature
$H_{con}$: Heat conductivity
$S_a$: Surface area
$H_{cap}$: Heat capacity $(H_c\times S_a/H_c)$ in Expression (9) is a very small value when experimentally calculated, specifically, in the order of 0.0001. Therefore, when the time period elapsed after the image formation is ended is about an hour (t=3,600), the scanner inside temperature can be substantially brought into linear approximation. When a non-linear region is exceeded during use, the scanner inside temperature of the optical box 401 can be estimated based on Expression (9). Therefore, when the color misregistration amount is estimated based on the time period elapsed after the image formation is ended, the error between the actual color misregistration amount and the estimated value can be reduced.

A description is made while comparing between the color misregistration amount depending on the scanner temperature and the color misregistration amount depending on the elapsed time period. For example, when images are formed at certain time intervals, the scanner temperature is increased from the vicinity of 32° C. to the vicinity of 46° C. After that, when small amounts of images are formed at certain time intervals, the scanner temperature is decreased to the vicinity of 32° C. The scanner temperature is gradually increased at the time of temperature increase (temperature increase characteristic), and sharply falls from the vicinity of 34° C. at the time of temperature decrease (temperature decrease characteristic).

Therefore, the temperature decrease characteristic in the vicinity of 34° C. has a change with a large slope. This change corresponds to, for example, a magnitude of about 40 μm when converted into the color misregistration amount per unit temperature. When the first estimation expression and the second estimation expression are switched with 34° C. being set as a boundary, the estimated value calculated based on the estimation expression used for a temperature lower than 34° C. may have a large estimation error in response to a small temperature error when an error is caused by an apparatus difference or a state. This is because the temperature decrease characteristic in the vicinity of 34° C. has a large color misregistration amount per unit temperature.

Figure 11:
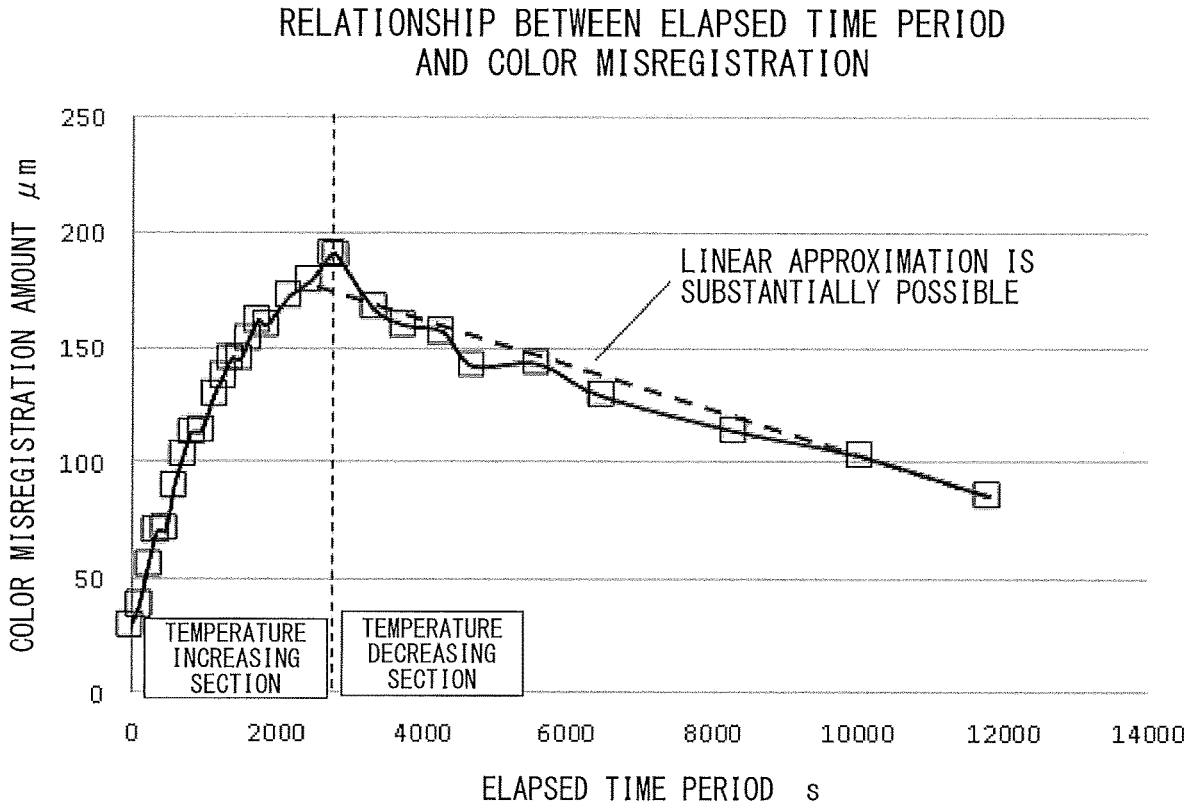
FIG. 11 is a graph for showing an association between a time period elapsed after image formation is ended and an actual color misregistration amount.

FIG. 11 is a graph for showing an association between the time period elapsed after the image formation is ended and the actual color misregistration amount. The relationship between the elapsed time period and the color misregistration amount is substantially linear at the time of temperature decrease. The elapsed time period has a small error because the elapsed time period is substantially accurate with respect to the scanner temperature. When the optical box 401 has a small heat capacity, even in a case in which the color misregistration amount becomes non-linear with respect to the elapsed time period, with use of Expression (8) as the second estimation expression, the estimated value of the color misregistration amount at the time of temperature decrease can be calculated with high accuracy.

In the processing of FIG. 10, the CPU 501 calculates the estimated value of the color misregistration amount based on Expression (8) in the processing of Step S105. Other processing is similar to that in the first embodiment. Also in the third embodiment, even when the scanner temperature changes to increase and decrease in a short time period, the color misregistration amount can be estimated with a smaller error. Therefore, the color misregistration can be corrected with high accuracy based on the estimated value of the color misregistration amount.

In the description above, the scanner temperature is a temperature of the exposure device 104 corresponding to a color being a target of color misregistration correction. For example, when the color misregistration is to be corrected for the magenta image, the CPU 501 uses the scanner temperature of the exposure device 104M to acquire the estimated value of the color misregistration amount. In a configuration in which one exposure device exposes the photosensitive drums 102Y, 102M, 102C, and 102K of the image forming portions 101Y, 101M, 101C, and 101K with light, the temperature of the one exposure device 104 corresponds to the scanner temperature.

In the first estimation expression, the second estimation expression, and the third estimation expression, the estimated value of the color misregistration amount is determined with use of the scanner temperature. However, the estimated value of the color misregistration amount may be determined with use of the scanner temperature and the developing temperature, or the estimated value of the color misregistration amount may be determined with use of the scanner temperature, the developing temperature, and the environment temperature. The developing temperature corresponds to a temperature detected by the developing temperature sensor 118 that functions as another temperature sensor, and the environment temperature corresponds to a temperature detected by the environment temperature sensor 117 that functions as yet another temperature sensor. The estimation expressions may be determined as appropriate by obtaining combinations of temperature information that can be used for estimation of the color misregistration amount through experiments.

According to the first to third embodiments described above, even when the in-apparatus temperature is repeatedly increased and decreased in a short time period, the color misregistration amount can be accurately estimated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-181688, filed Sep. 27, 2018, which is hereby incorporated by reference herein in its entirety.

What is claimed is:

1. An image forming apparatus, comprising:

a first image forming unit configured to form a first image of a first color, the first image forming unit including:

a first photosensitive member;

a first exposure unit configured to expose the first photosensitive member with light in order to form a first electrostatic latent image; and a first developing unit configured to develop the first electrostatic latent image formed on the first photosensitive member;

a second image forming unit configured to form a second image of a second color that is different from the first color, the second image forming unit including:

a second photosensitive member;

a second exposure unit configured to expose the second photosensitive member with light in order to form a second electrostatic latent image; and a second developing unit configured to develop the second electrostatic latent image formed on the second photosensitive member;

a transfer member onto which the first image and the second image are to be transferred;

a transfer nip at which the first image and the second image are transferred onto a sheet from the transfer member;

a pattern sensor configured to measure a color pattern formed on the transfer member, the color pattern being used for detection of color misregistration;

a temperature sensor, which is provided in the first exposure unit, and is configured to detect a temperature; and a controller configured to:

control the first image forming unit and the second image forming unit to form a plurality of color patterns including a color pattern of the first color and a color pattern of the second color;

control the pattern sensor to measure the plurality of color patterns;

detect first color misregistration between the color pattern of the first color and the color pattern of the second color based on a measurement result of the pattern sensor;

determine, in a case in which (i) the detected temperature is increased, second color misregistration from the detected temperature based on a first determination condition;

determine, in a case in which (ii) the detected temperature is decreased and (iii) a time period elapsed from the previous image formation is longer than a predetermined time period, the second color misregistration from the detected temperature based on a second determination condition that is different from the first determination condition;

determine, in a case where (iv) the detected temperature is decreased and (v) the elapsed time period is shorter than the predetermined time period, the second color misregistration from the detected temperature based on a third determination condition that is different from the second determination condition; and correct relative positions of an image to be formed by the first image forming unit and an image to be formed by the second image forming unit based on the first color misregistration and the second color misregistration.

2. The image forming apparatus according to claim 1, wherein the third determination condition is equivalent to the first determination condition.

3. The image forming apparatus according to claim 1, wherein the first exposure unit includes:

a light source;

a control board configured to control the light source;

a deflection member configured to deflect light emitted from the light source;

a motor configured to drive the deflection member; and a case configured to house the motor, wherein the temperature sensor is mounted on the control board, and wherein the control board is provided outside of the case.

4. The image forming apparatus according to claim 1, wherein the controller is configured to determine whether the detected temperature is increased based on a current detection result of the temperature sensor and a detection result of the temperature sensor at the time of the previous image formation, and wherein the controller is configured to determine whether the detected temperature is decreased based on the current detection result of the temperature sensor and the detection result of the temperature sensor at the time of the previous image formation.

5. An image forming apparatus, comprising:

a first image forming unit configured to form a first image of a first color, the first image forming unit including:

a first photosensitive member;

a first exposure unit configured to expose the first photosensitive member with light in order to form a first electrostatic latent image; and a first developing unit configured to develop the first electrostatic latent image formed on the first photosensitive member;

a second image forming unit configured to form a second image of a second color that is different from the first color, the second image forming unit including:

a second photosensitive member;

a second exposure unit configured to expose the second photosensitive member with light in order to form a second electrostatic latent image; and a second developing unit configured to develop the second electrostatic latent image formed on the second photosensitive member;

a transfer member onto which the first image and the second image are to be transferred;

a transfer nip at which the first image and the second image are transferred onto a sheet from the transfer member;

a pattern sensor configured to measure a color pattern formed on the transfer member, the color pattern being used for detection of color misregistration;

a temperature sensor, which is provided in the first exposure unit, and is configured to detect a temperature; and a controller configured to:

control the first image forming unit and the second image forming unit to form a plurality of color patterns including a color pattern of the first color and a color pattern of the second color;

control the pattern sensor to measure the plurality of color patterns;

detect first color misregistration between the color pattern of the first color and the color pattern of the second color based on a result of the measurement;

determine, in a case in which (i) the detected temperature is increased, second color misregistration from the detected temperature based on a first determination condition;

determine, in a case in which (ii) the detected temperature is decreased and (iii) a time period elapsed from the previous image formation is longer than a predetermined time period, the second color misregistration from the detected temperature based on a second determination condition that is different from the first determination condition;

determine, in a case in which (iv) the detected temperature is decreased, and (v) the elapsed time period is shorter than the predetermined time period, the second color misregistration from the elapsed time period based on a third determination condition; and correct relative positions of an image to be formed by the first image forming unit and an image to be formed by the second image forming unit based on the first color misregistration and the second color misregistration.

6. The image forming apparatus according to claim 5, wherein the first exposure unit includes:

a light source;

a control board configured to control the light source;

a deflection member configured to deflect light emitted from the light source;

a motor configured to drive the deflection member; and a case configured to house the motor, wherein the temperature sensor is mounted on the control board, and wherein the control board is provided outside of the case.

7. The image forming apparatus according to claim 5, wherein the controller is configured to determine whether the detected temperature is increased based on a current detection result of the temperature sensor and a detection result of the temperature sensor at the time of the previous image formation, and wherein the controller is configured to determine whether the detected temperature is decreased based on the current detection result of the temperature sensor and the detection result of the temperature sensor at the time of the previous image formation.

* * * * *